United States Patent [19]

Morell et al.

[11] Patent Number: 4,636,429

[45] Date of Patent: Jan. 13, 1987

[54] DUSTING CLOTH

[75] Inventors: Charles J. Morell, Atlanta; Mark D. Strickland, Roswell, both of Ga.

[73] Assignee: Kimberly-Clark Corporation, Neenah, Wis.

[21] Appl. No.: 818,435

[22] Filed: Jan. 13, 1986

[51] Int. Cl.[4] ..... B32B 27/12

[52] U.S. Cl. ..... 428/288; 428/290

[58] Field of Search ..... 428/290, 280, 288

[56] References Cited

U.S. PATENT DOCUMENTS

| | | | |
|---|---|---|---|
| 3,236,685 | 2/1966 | Caldwell et al. | 117/138.8 |
| 3,320,088 | 5/1967 | Feild | 117/138.8 |
| 3,348,968 | 10/1967 | Hulbert et al. | 117/138.8 |
| 3,922,462 | 11/1975 | Katz et al. | 428/290 |
| 4,065,598 | 12/1977 | Takahashi et al. | 428/394 |
| 4,264,645 | 4/1981 | von Bonin et al. | 427/55 |
| 4,264,659 | 4/1981 | Pattenden | 428/35 |
| 4,374,894 | 2/1983 | Antlfinger | 428/288 |
| 4,413,032 | 11/1983 | Hartmann et al. | 428/288 |
| 4,515,848 | 5/1985 | Leunig et al. | 428/172 |

*Primary Examiner*—Alexander S. Thomas

*Attorney, Agent, or Firm*—William D. Herrick

[57] ABSTRACT

A nonwoven polypropylene web has enhanced dusting capabilities by treating it with from about 0.1% to 5.0% by weight of polypropylene glycol having a molecular weight from about 400 to 1000.

8 Claims, No Drawings

DUSTING CLOTH

BACKGROUND OF THE INVENTION

This invention relates generally to wipes and cloths for use in dusting, and more particularly concerns treatments for non-woven polypropylene webs which increase the webs' ability to attract and hold dust when the webs are used as wipes or dust cloths.

Oils and other additives have long been used in connection with textile woven and non-woven dust cloths and mops to enhance the ability of the cloths or mops to attract and hold dust particles when the cloths or mops are wiped over a surface. Such additives, however, do not always completely adhere to the dust cloths or mops, and tend to smear onto the wiping surface or onto the user's hands. In many applications, such a smeared residue left behind after dusting represents contamination which in certain industrial and commercial contexts cannot be tolerated.

In addition, commercial wipes and dust cloths are increasingly being made from webs of non-woven polyolefinic materials such as polypropylene. Such webs may be made by a melt-blown process which involves heating the polymer resin to form a melt, extruding the melt through a die orifice in a die head, directing a stream of heated fluid, usually air, toward the melt exiting the die orifice to form filaments or fibers that are discontinuous and attenuated, and collecting the fibers on a drum or foraminous belt to form a web. Because the fibers are still tacky when they are collected, they bond together to form an integrated web. Other fibers, such as staple or pulp fibers, may be added to the melt-blown fibers to form a so-called coform web.

The melt-blown process which can be used for making such wipes and dusting cloths is well-known and is described in various patents and publications, including NRL Report 4364, "Manufacture of Super-Fine Organic Fibers" by V. A. Wendt, E. L. Boon, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241 issued Nov. 19, 1974 to Butin, et al.

Non-woven webs for dusting cloths may also be made by a spun-bond process in which polypropylene is heated and extruded into continuous fine filaments which are randomly cross-laid onto a collecting drum or belt. Because the filaments are still tacky when they are collected, they bond at their points of intersection to form a cohesive web.

In addition, dusting cloths can be made by serially forming layers of spun-bond and melt-blown material one on top of the other to form a web. Because the spun-bond and melt-blown layers are laid down on the same collecting belt within close-timed proximity, the filaments are still tacky so that the layers bond together. Also, laminates of melt-blown and spun-bonded webs may be made for use as dusting cloths.

There is, however, little attraction between dust particles and untreated non-woven polypropylene webs. Dust is collected on such webs primarily due to physical capture of the dust particles by the fibers of the webs, and therefore, it is recognized that additives or treatments are necessary to enhance the dusting capabilities of non-woven polypropylene webs.

While the prior art has not specifically addressed the question of treating non-woven polypropylene webs to enhance their dusting abilities, the prior art does disclose several treatments for polypropylene webs for enhancing other characteristics.

Von Bonin U.S. Pat. No. 4,264,645 discloses treating synthetic polyolefin fleeces with a hydrophilising agent to improve the water vapor absorption capacity of the fleece. The hydrophilising agent is a polymeric organic compound which is a long polymerized chain of polyethylene oxide and polypropylene oxide having molecular weights between about 500 and 8500. While the polymerized hydrophilising agent gives the synthetic fleece material added water absorbing characteristics, the polymerized cross-link chain does not adhere sufficiently to the fleece to assure that if used as a wipe it would not smear.

Takahashi et al. U.S. Pat. No. 4,065,598 discloses a process for imparting anti-static, soil-release, and water-absorbing properties to synthetic polyolefin fibers. In one example (Example 4), polyethylene glycol trimethacrylate is used to treat the polyolefin yarn. The treatment does not appear to enhance the ability of a non-woven polyethylene or polypropylene web to attract dust.

SUMMARY OF THE INVENTION

It is therefore an object of the present invention to provide a treatment for non-woven polypropylene webs which treatment will enhance the webs' ability to attract and hold dust and which will not smear onto the dusting surface.

In order to achieve the above objective, we have discovered that treating non-woven polypropylene webs with polypropylene glycol having molecular weights between 400 and 1000 increases the ability of the non-woven webs to attract dust by as much as 100%. The treatment amounts to an add-on by weight of approximately 0.1% to 5.0% with particularly good results occurring at low add-ons of between 0.4% and 2.0%.

Other objects and advantages of the invention will become apparent upon reading the following detailed description.

DETAILED DESCRIPTION OF THE INVENTION

While the invention will be described in connection with the preferred embodiment, it will be understood that we do not intend to limit the invention to that embodiment. On the contrary, we intend to cover all alternatives, modifications, and equivalents as may be included within the spirit and scope of the invention as defined by the appended claims.

Nonwoven webs of polypropylene fibers offer an attractive material for making disposable dusting cloths because such webs can be formed in a variety of ways to provide a variety of physical characteristics at a cost that insures the economics of disposability. Typically nonwoven webs of polypropylene can be formed by melt-blowing or spun-bonding.

Melt-blown webs of polypropylene are made by heating the polymer resin to form a melt, extruding the melt through a die orifice in a die head, directing a stream of fluid, usually air, toward the melting exiting the die orifice to form filaments or fibers that are discontinuous and attenuated, and collecting the fibers on a drum or foraminous belt to form a web. The physical characteristics of the melt-blown polypropylene web can be adjusted in accordance with principles well known in the art by manipulating the various process parameters used in carrying out the melt-blown process.

Polypropylene webs for dust cloths can also be made by the spun-bonded process which involves heating the polymer resin to form a melt, extruding the melt through a die orifice in a die head to form continuous filaments, and collecting the filaments on a drum or foraminous belt to form a web. The physical characteristics of the spun-bonded web can be adjusted in accordance with principles well known in the art by manipulation of the various process parameters used in carrying out the spun-bonded process.

In addition to melt-blown and spun-bonded webs, composite webs may be formed of polypropylene material which can be used as dust cloths. One example of such a composite web is formed by laying down a layer of spun-bonded polypropylene fibers onto a forming belt followed directly by laying down a layer of melt-blown polypropylene fibers on top of the spun-bonded layer, and finally laying down another layer of spun-bonded material directly on top of the melt-blown material. Because the layers are laid down one on top of the other in close-timed proximity, the layers are still tacky so that they bond to each other to form an integral web.

Another candidate for dust cloths for use in connection with the present invention is to make a coform web. Coform results from mixing staple or pulp fibers with the melt-blown fibers at the outlet of the die orifice while the melt-blown fibers are being formed. The resulting web has the staple or pulp fibers intimately mixed with the melt-blown polypropylene fibers and adhered to the melt-blown fibers as a result of the tackiness of the melt-blown fibers at the time the staple or pulp fibers first contact them prior to being collected on the forming belt.

Dust cloths made in accordance with the above-described processes, which processes are generally well known in the art, do not, however, have sufficient attraction for dust to be useful as dust cloths. In that regard, we have discovered that by treating the polypropylene webs with polypropylene glycols of molecular weights from about 400 to 1000 the polypropylene webs nearly double their capacity for attracting and picking up dust. Polypropylene glycol having a molecular weight of 425 is preferred. Moreover, the polypropylene glycol adheres sufficiently to the polypropylene fibers so that it does not smear onto the wiping surface when the webs are used as dust cloths.

Polypropylene glycols can be applied to the polypropylene webs via a water base carrier system, either in solution or as an emulsion depending upon the solubility of the particular grade of polypropylene glycol being used. Methods of application include spraying after web formation, spraying during web formation as part of the quenching system for the webs, saturating and drying, as well as several other known processes for coating.

We have found that the polypropylene webs exhibit significant improvement when treated with polypropylene glycols in the range of 0.1% to 5.0% by weight. Low add-ons, however, in the range of 0.4% to 2.0% also acheive good results without smearing. Preferably, best results are acheived with add-ons of 0.5% to 1.0%.

The following examples demonstrate the improved dust attraction and pick-up properties of polypropylene webs treated in accordance with the present invention as compared to untreated polypropylene webs. In addition, the examples made in accordance with the present invention exhibit low smearing of the polypropylene glycol additive onto the wiping surface.

EXAMPLE 1

A 4 inch by 4 inch control sample is cut from a melt-blown polypropylene web having a basis weight of 2.4 oz./yd.$^2$.

EXAMPLE 2

A 4 inch by 4 inch sample identical to the sample in Example 1 is treated with a 4.0% add-on of polypropylene glycol having a molecular weight of 425.

EXAMPLE 3

A 4 inch by 4 inch sample identical to the sample in Example 1 is treated with a 0.4% add-on of polypropylene glycol having a molecular weight of 425.

EXAMPLE 4

A 4 inch by 4 inch sample is cut from a laminate having a total basis weight of 2.4 oz./yd.$^2$ and consisting of two outer layers of spun-bonded polypropylene and an inner layer of melt-blown polypropylene.

EXAMPLE 5

A 4 inch by 4 inch sample identical to the sample in Example 4 is treated with a 4.3% add-on of polypropylene glycol having a molecular weight of 425.

In order to test the effectiveness of the treatments made in accordance with the present invention, the following test protocol was established.

MATERIALS AND EQUIPMENT

Ball Mill
Cylindrical Canister w/Baffles (height = 6.5" diameter = 6.75")
Silicon Glass Spheres (325 mesh or finer)
Balance
Stop Watch

PROCEDURE

The sample (4"×4") is weighed prior to the test and placed in the canister. The canister is placed on its side and 15 grams of the synthetic dust (glass spheres) are poured evenly in a line along the side. The canister is covered and placed on the ball mill, and the ball mill is started. The canister is allowed to tumble for 15 seconds, and the sample is weighed again. The difference between this weight and the original weight of the sample is recorded as the dust pick-up (grams).

Table 1 below shows the results of the tests:

TABLE 1

| | SAMPLE | W/W % TREATMENT ADD-ON | DUST PICK-UP (g) |
|---|---|---|---|
| Example 1 | unbonded MB (control) | — | 0.76 |
| Example 2 | PPG-treated unbonded MB | 4.0 | 1.67 |
| Example 3 | PPG-treated unbonded MB | 0.4 | 1.56 |
| Example 4 | SMS (control) | — | 1.60 |
| Example 5 | PPG-treated SMS | 4.3 | 2.50 |

We claim:

1. A dusting cloth comprising a non-woven polypropylene web treated with from about 0.1% to 5.0% by weight of polypropylene glycol having molecular weights between 400 and 1000.

2. The dusting cloth of claim 1, wherein the polypropylene web is a melt-blown web.

3. The dusting cloth of claim 1, wherein the polypropylene web is a spun-bonded web.

4. The dusting cloth of claim 1, wherein the polypropylene web is a coform web.

5. The dusting cloth of claim 1, wherein the polypropylene web is a laminate of melt-blown and spun-bonded webs.

6. The dusting cloth of claim 1, wherein the polypropylene glycol has a molecular weight of 425.

7. The dusting cloth of claim 1, wherein the polypropylene web is treated with from about 0.4% to 2.0% by weight of polypropylene glycol.

8. The dusting cloth of claim 7 wherein the polypropylene web is treated with from about 0.5% to 1.0% by weight of polypropylene glycol.

* * * * *